United States Patent [19]

Tamura et al.

[11] 3,963,811

[45] June 15, 1976

[54] PROCESS FOR PRODUCING A COMPOSITE METAL POWDER

[75] Inventors: Kiyoshi Tamura, Kawasaki; Tohru Takeda, Sagamihara, both of Japan

[73] Assignee: National Research Institute for Metals, Tokyo, Japan

[22] Filed: Mar. 14, 1974

[21] Appl. No.: 451,047

[30] Foreign Application Priority Data

June 4, 1973 Japan ..... 48-61867

[52] U.S. Cl. ..... 264/7; 264/11

[51] Int. Cl.[2] ..... B01J 2/02

[58] Field of Search ..... 264/7, 11, 12

[56] References Cited

UNITED STATES PATENTS

| | | | |
|---|---|---|---|
| 2,636,219 | 4/1953 | Beamer et al. | 264/11 |
| 3,532,775 | 10/1970 | Brondyke et al. | 264/7 |
| 3,655,837 | 4/1972 | Reed et al. | 264/7 |

*Primary Examiner*—Robert F. White
*Assistant Examiner*—James R. Hall
*Attorney, Agent, or Firm*—Sherman & Shalloway

[57] ABSTRACT

A process for producing a composite metal powder which comprises mixing a powder of a metal or alloy with a melt of a metal or alloy of a different class from that of the metal or alloy powder and atomizing the resulting molten mixture by jetting a high speed jet stream of water against the stream of the mixture to thereby obtain a composite metal powder in which the surface of the metal or alloy powder is coated with a layer of the originally molten or alloy.

5 Claims, 4 Drawing Figures

PROCESS FOR PRODUCING A COMPOSITE METAL POWDER

Figure 1:
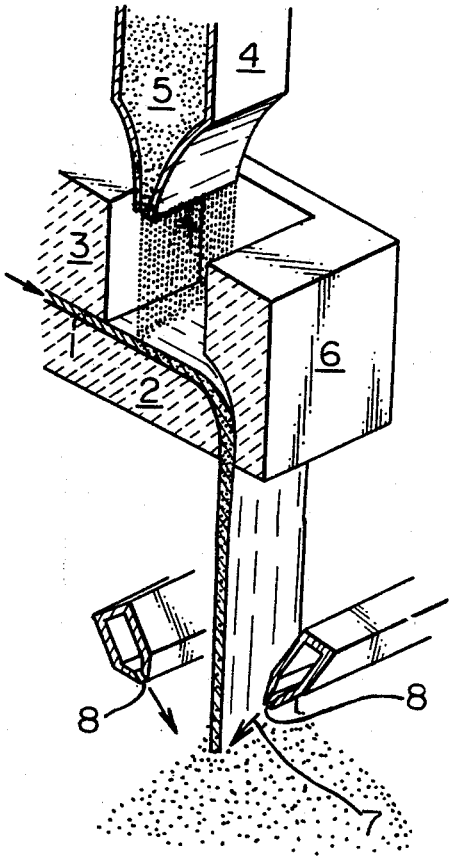

This invention relates to a process for producing a composite metal powder in which the surface of a powder of a metal or alloy is coated with a different class of metal or alloy.

The powder metallurgy art by which metallic products such as parts of machines are produced by sintering metals of powdered form is known. The metal powders used as starting material in powder metallurgy is usually either a mixture of two or more classes of simple metal powders or a powder of an alloy.

In the case of the process where a mixture of two or more classes of simple metal powders is used, since the constituent metal powders must be prepared separately, the process is troublesome. Further, as difficulty is involved in homogeneously mixing the several constituent metal powders, segregation of the constituent powders tends to take place. Again, there is the shortcoming that a complex change takes place in the dimensions of the powder during the sintering operation to adversely affect the resulting sintered product.

On the other hand, the process in which the alloy powder is used has a serious drawback in that the compression moldability of the alloy powders is poor.

As one method of overcoming these difficulties, a composite metal powder is utilized. This composite metal powder consists of one metal or alloy powder making up the nucleus, which nucleus is coated with another class of metal or alloy. The use of a composite metal powder has the advantages that not only the mixing operation is obviated but also the compression moldability and sintering properties are improved.

As methods of producing a composite metal powder, those known to date include (1) the chemical substitution method in which the surface of a metal powder is replaced chemically with another metal, and (2) the coprecipitation method wherein two or more classes of metal compounds are chemically precipitated. However, none of these methods are suitable for large-scale production and, hence, since the cost of the powder is high, these methods were not of commercial advantage. Further, there was imposed a great limitation as to the class of metals that were usable.

It is therefore an object of the present invention to provide a process by which the commposite metal powders can advantageously be produced without employing the chemical methods. Another object is to provide a process by which the composite metal powders can be produced continuously at a high efficiency.

The foregoing objects of the present invention are achieved by a process for producing composite metal powders or the mixtures thereof which comprises mixing a powder of a metal or alloy with a melt of another metal or alloy of a temperature lower than the melting point of the metal or alloy powder, causing the resulting molten mixture to flow as a continuous stream, jetting a stream of a high speed fluid against the stream of molten mixture to atomize the continuous stream of molten mixture, and thereafter cooling and solidifying the resulting fine particles to thereby obtain a composite metal powder in which the particle surface of the metal or alloy powder is coated with the originally molten metal or alloy, or a mixture of the composite metal powder and a powder of the originally molten metal or alloy.

It is possible according to the process of the present invention to use an exceedingly great variety of combinations of the nucleate metal or alloy powder and the coating metal or alloy. Preferred combinations are illustrated in the following Table 1.

Table 1

| Nucleate metal or alloy | Coating metal or alloy | Composition | |
|---|---|---|---|
| copper (2 – 10%, preferably 5%) | aluminum (98 – 90%, preferably 95%) | | — |
| chromium or ferrite type ferrochrome | iron | Cr | 15 – 25 % |
| Ni Cr—Fe (austenite type ferrochrome) | do | Cr | 12 – 25 % |
| | | Ni | 4 – 20 % |
| Ni—Ti—Al—Mo—Cr—Co | Ni | Ti | 1 – 5 % |
| | | Al | 1 – 5 % |
| | | Mo | 1 – 5 % |
| | | Cr | 10 – 20 % |
| | | Co | 10 – 20 % |
| Ni—Ti—Al—Mo—Cr | Ni—Co | Ti | 1 – 5 % |
| | | Al | 1 – 5 % |
| | | Mo | 1 – 5 % |
| | | Cr | 10 – 20 % |
| | | Co | 10 – 20 % |
| copper-tin | copper | | |
| copper | tin | | |

The metal powder (or alloy powder) used as the nucleus of the composite metal powder is that having preferably a particle size not greater than that passing through a 200-mesh sieve, and more preferably not greater than that passing through a 350-mesh sieve.

The amount of metal or alloy powder fed to the melt varies depending upon the dimension of the powder to be added. However, this amount is preferably not more than about 50% by volume, and more preferably 20–30% by volume.

For atomizing the continuous stream of the mixture of the melt and the metal or alloy powder to obtain a composite metal powder, a high speed fluid is jetted against the continuous stream of the molten mixture. Water, air, nitrogen, argon and mixtures of air and steam are suitably used as the high speed fluid. However, the usable fluid is not limited to these fluids. Particularly preferred is water.

The high speed fluid is conveniently jetted at a speed of 30 meters to 200 meters per second and in an amount of 20 liters to 400 liters per minute.

Any of the known mixing procedures may be used in mixing the metal or alloy powder with the melt. However, it is convenient to carry out the mixing in the following manner. The melt is caused to flow as a continuous stream, and preferably as a thin layer. The metal or alloy powder is than dropped continuously into the melt from a slit disposed above the continuous stream of the melt.

Figure 2:
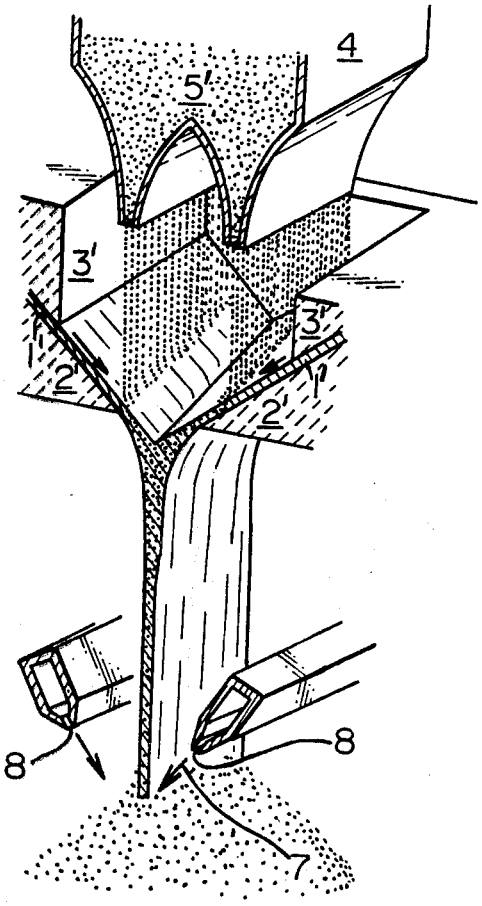
Figure 3:
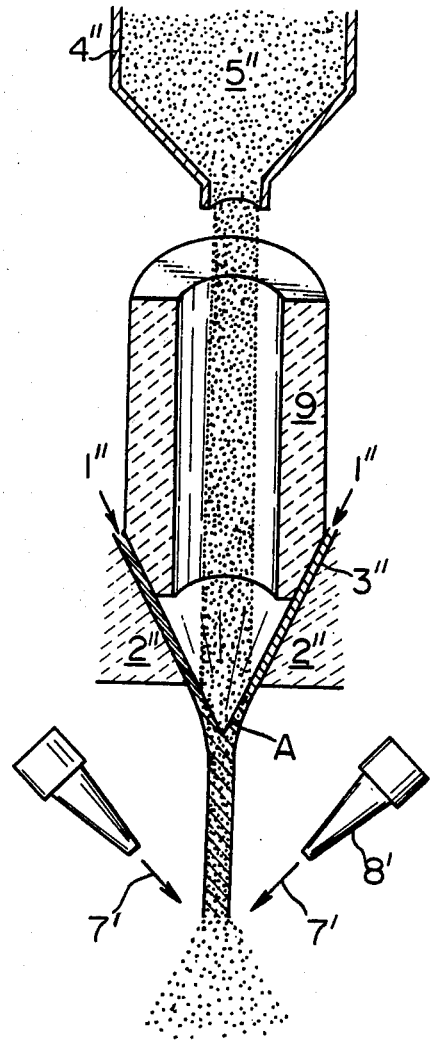

FIGS. 1–3 of the accompanying drawings are views illustrating the procedures for mixing the melt and the powder in accordance with the present invention.

FIG. 1 illustrates one mode in which the metal or alloy powder is mixed in with the melt flowing in one direction. Melt 1 flows at a rate of 100–200 grams per second, for example, in a given direction in a vessel 2 formed from a refractory such as alumina, etc., and after its level has been adjusted by means of a slit 3 provided in the vessel 2 at a point just prior to where the mixing is performed, it is admixed with a metal or alloy powder 5 that has been dropped uniformly from a metal or alloy powder feeding tank 4 disposed above the aforesaid vessel 2, after which the resulting mixture is made to flow down in ribbon fashion by means of a baffle 6. This mixture stream is then atomized and cooled with a high speed jet stream 7 or 7' (FIG. 3) from a plurality of nozzles 8 or slits 8' (FIG. 3) to form a composite metal or alloy powder, i.e., a powder having as its nucleus the metal or alloy powder and as its coating the originally molten metal or alloy. LThe plurality of nozzles or slits that jet the high speed fluid are so disposed that they either incline in the same direction as that of the stream of molten mixture or intersect perpendicular thereto so that the jet stream jetted from the nozzles or slits intersects the stream of molten mixture at a given point. A jet stream jetting apparatus of this kind is known per se. The apparatus disclosed in Japanese Patent No. 552,253 is conveniently used.

FIG. 2 illustrates a mode wherein the mixing is carried out using a plurality of slits for the melt and a plurality of powder feeding tanks. Melt 1 flows through the V-shaped vessel 2' and, after its level has been adjusted by means of the respective slits 3' provided at that point just before the part where the mixing is to be performed, is mixed with the powder 5' that has been uniformly dropped onto the respective melt surfaces from the two feed ports of the powder feed tank 4' disposed above the aforesaid vessel 2', following which the two mixture streams are brought together at the angulate bottom of the vessel and allowed to flow down in ribbon fashion. This mixture stream is atomized and cooled in the same manner as hereinbefore described to obtain the composite powder.

The dropping port of the powder feeding tank shown in FIGS. 1 and 2 can be of slit form having a rectangular or wavy shape or the form of orifices for ensuring that a uniform mixing of the powder and melt stream is achieved.

FIG. 3 illustrates a mode in which the vessel is of conic shape. Melt 1'' flows down over a vessel 2'' of refractor of material such as alumina formed in conic shape and passes through a slit 3'' formed by means of a spindle 9 to come together at point A. A powder feeding tank 4'' is disposed above the point A, and powder 5'' is allowed to drop uniformly from feeding tank 4'' to become admixed with the melt. The so obtained mixture stream is then atomized and cooled by means of a high speed fluid jetted from either a circular slit or annularly disposed nozzles 8'' to form the composite powder. According to this method, the amount of melt fed can very readily be adjusted by a vertical movement of the spindle 9. On the other hand, when the adjustment of the amount fed of the melt by a vertical movement of the spindle is not necessary, it is possible to provide a plurality of orifices at this part instead of the spindle. For avoiding the solidification of the melt at the slit portion, in all of the foregoing modes, preheating of this portion is performed at the time of starting the operation of the apparatus.

EXAMPLE

The apparatus shown in FIG. 3 was employed, and molten tin of 800°C. was allowed to flow down from slit 3'' at a rate of 70 grams per second, while a 350-mesh copper powder was allowed to drop uniformly into the molten tin at the rate of 8 grams per second to form a stream consisting of a mixture of the melt and powder. This mixed stream was then atomized with a 180 meter per minute high speed water stream flowing at the rate of 200 liters per minute, using the liquid atomizing apparatus disclosed in Japanese Patent No. 552,253, followed by cooling the resulting fine particles to thus prepare the composite powder.

Figure 4:
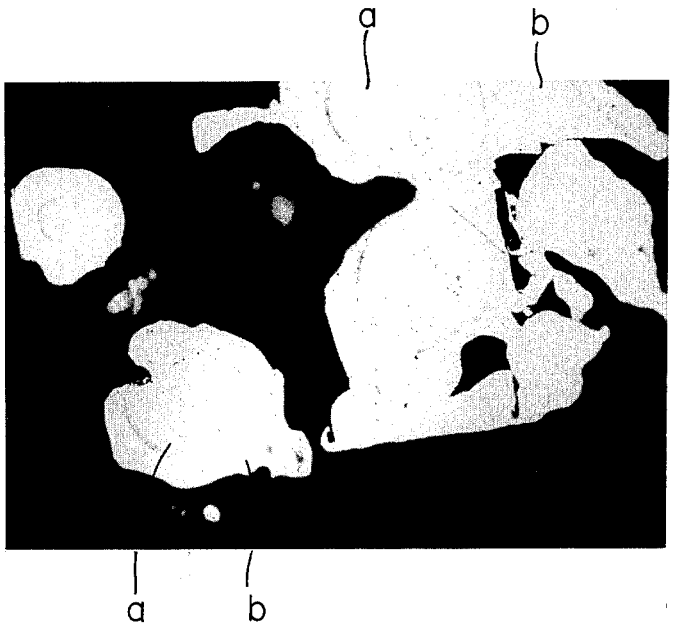

FIG. 4 is a photomicrograph (450X) of a section of the so obtained powder, *a* in the photograph being copper and *b* being tin.

The photomicrograph of FIG. 4 is a photograph of a sample obtained by embedding the composite powder obtained in the Example in a synthetic resin and then cutting the so embedded powder. On examination of this sample, it was found that the powder obtained in the Example was a composite powder consisting of copper as the nucleus and tin as the coating, i.e., a mixture of 15% by volume of copper and 85% by volume of tin.

In the case of the invention composite metal or alloy powder, a wide choice of combinations between the metal or alloy powder to become the nucleus and the metal or alloy to become the coating is possible. Hence, the compression moldability, the most serious shortcoming in the case of the conventional alloy powder, and the problem of segregation of the components, the drawback in the case of the conventional powder mixtures, are surmounted by a suitable choice of the metal to be used for the coating; for instance, in the case of bronze powder, by using pure copper for the coating and an alloy of copper and tin for the nucleus; and in the case of an alloy steel, by using pure iron for the coating. On the other hand, if pure iron is used as the coating in the case of the use of an alloy steel powder containing, as its alloy component, an element having great affinity for oxygen, for example, Ti, the oxidation during the initial stage when sintering is proceeding between the particles can be prevented, with the consequence that there is the advantage that it becomes possible to achieve a full growth of the neck.

In the following claims the term "metal" includes both pure metals and metal alloys.

What is claimed is:

1. A process for producing a composite metal powder comprising a nucleus of a first metal and a coating of a second metal, said process comprising a. mixing powder having a particle size not greater than 200 mesh of a first metal with a melt of a second metal, said metal having a temperature lower than the melting point of said metal powder, the amount of powder to melt by volume not exceeding 50%, b. flowing as a continuous stream the resulting molten mixture of said first and second metals, c. jetting a stream of a fluid against said continuous stream of molten mixture at a rate of 30 to 200 meters per second to atomize said continuous stream of molten mixture into fine particles, and d. cooling and solidifying the resulting fine particles to thereby obtain a composite metal powder in which the surfaces of the particles of said first metal, as the nucleus, are coated with said originally molten second metal.

2. The process of claim 1 wherein said jet stream of the step (c) is water.

3. The process of claim 1 wherein the mixing step (a) comprises flowing the melt as a continuous stream and dropping the metal powder into the melt stream from a slit disposed above said melt stream.

4. The process of claim 1 wherein said first metal powder forming the nucleus of said composite metal powder has a particle size not greater than 350 mesh.

5. The process of claim 1 wherein in step (a) the amount of powder to melt by volume is from 20 to 30%.

* * * * *